US010106368B2

(12) United States Patent
Sajid et al.

(10) Patent No.: US 10,106,368 B2
(45) Date of Patent: Oct. 23, 2018

(54) DEVICE FOR QUICKLY AND EFFICIENTLY ROLLING GARMENTS AND OTHER ITEMS

(71) Applicants: Salman Sajid, Los Angeles, CA (US); Jonathan Lumbley, West Hollywood, CA (US)

(72) Inventors: Salman Sajid, Los Angeles, CA (US); Jonathan Lumbley, West Hollywood, CA (US)

(73) Assignee: Three Sevens LLC, Glendale, CA (US)

( * ) Notice: Subject to any disclaimer, the term of this patent is extended or adjusted under 35 U.S.C. 154(b) by 553 days.

(21) Appl. No.: 14/638,982

(22) Filed: Mar. 4, 2015

(65) Prior Publication Data

US 2016/0257515 A1 Sep. 8, 2016

(51) Int. Cl.

| | |
|---|---|
| ***B65H 75/10*** | (2006.01) |
| ***B65H 75/24*** | (2006.01) |
| ***A47G 25/72*** | (2006.01) |
| ***A47G 25/78*** | (2006.01) |

(52) U.S. Cl.

CPC ..... *B65H 75/241* (2013.01); *A47G 25/72* (2013.01); *A47G 25/78* (2013.01); *B65H 75/10* (2013.01); *B65H 2402/412* (2013.01)

(58) Field of Classification Search

CPC ..... B65H 75/10; B65H 75/241; A47G 25/72; A47G 25/78

See application file for complete search history.

(56) References Cited

U.S. PATENT DOCUMENTS

| | | | | |
|---|---|---|---|---|
| 7,937,915 | B2 * | 5/2011 | Kohn | B65B 67/085 242/422.4 |
| 7,942,364 | B2 * | 5/2011 | Yu Chen | B65H 75/241 242/578.2 |
| 8,616,490 | B2 * | 12/2013 | Blok | B65B 67/085 242/405.3 |
| 2007/0145179 | A1 * | 6/2007 | Engelsher | A61F 15/007 242/532.6 |
| 2013/0227913 | A1 * | 9/2013 | Harrison | B65B 67/085 53/203 |

* cited by examiner

*Primary Examiner* — Sang Kim

(57) ABSTRACT

A device for rolling garments and other items, comprising an adjustable length rod operable to move between a locked position and a retractable position by twisting the adjustable length rod. There is a handle on one end of the rod capable of fully housing the adjustable length rod when fully retracted in its retractable position, a securing clip operable to move between an open position and a closed position connected to the handle for securing an item to the rod, and a securing clip button on the handle for triggering the securing clip to its open or closed position. The device includes safety mechanisms, with a quick-release button on the end of the handle that is movable between an engaged and a disengaged position, and a quick-release slide switch movable between an up and down position.

6 Claims, 15 Drawing Sheets

FIG. 13A
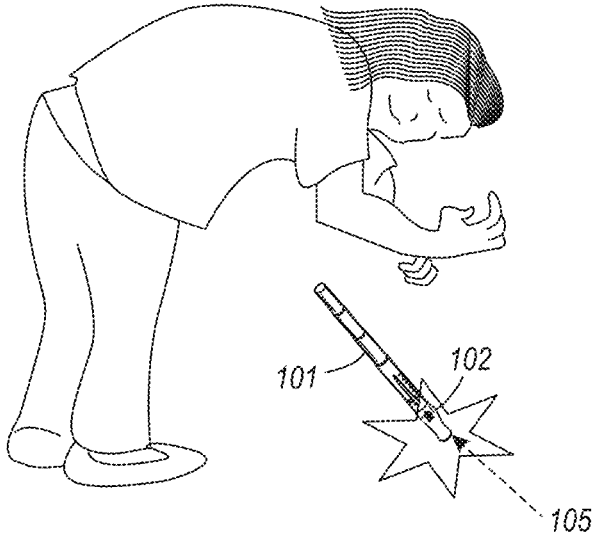
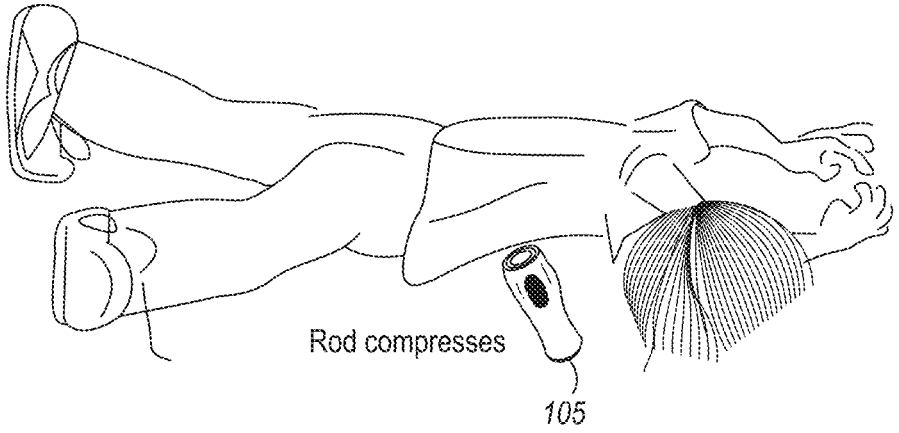
FIG. 13B

DEVICE FOR QUICKLY AND EFFICIENTLY ROLLING GARMENTS AND OTHER ITEMS

FIELD OF THE INVENTION

The present invention is a device to quickly and efficiently roll garments and other items for wrinkle free storage or travel.

BACKGROUND OF THE INVENTION

Items such as garments and pieces of clothing often need to be quickly rolled for easy storage or travel. By rolling them, garments will not take too much space and can stay wrinkle free for later use. This makes rolling garments an ideal option for travel since rolled garments can be tucked away in the luggage without taking too much space and staying wrinkle free.

Additionally, rolling garments and other items is very common at retail stores, where clothes must be quickly rolled wrinkle free and efficiently stored. Therefore, a device for quickly and efficiently rolling garments and other items for wrinkle free storage and travel is desirable.

SUMMARY

In accordance with the present invention, various advantageous devices for rolling garments and other items are provided which allow for quickly rolling items. A preferred embodiment includes a device for rolling a garment item, comprising an adjustable length rod, made up of at least two sub-rod pieces, operable to move between a locked position and a retractable position by twisting the adjustable length rod. There is a handle on one end of the adjustable length rod capable of fully housing the adjustable length rod when fully retracted in its retractable position, and a securing clip operable to move between an open position and a closed position connected to the handle used to secure the garment item to the adjustable length rod. A securing clip button on the handle allows for triggering the securing clip to its open or closed position.

Further, a quick-release safety mechanism is provided having a quick-release button on the end of the handle that is movable between an engaged position in which pressure is applied to the quick-release button to release the adjustable length rod into its retractable position, and a disengaged position in which no pressure is applied to the quick-release button causing the adjustable length rod to be in a locked position. The quick-release safety mechanism also has a quick-release slide switch that is movable between an up position in which the adjustable length rod is released into its retractable position, and a down position in which the adjustable length rod remains in a locked position.

BRIEF DESCRIPTION OF THE DRAWINGS

FIGS. 13A and 13B illustrate the quick-release safety mechanism where the rod retracts into the handle when pressure is applied;

DETAILED DESCRIPTION OF THE PREFERRED EMBODIMENTS

Figure 1:
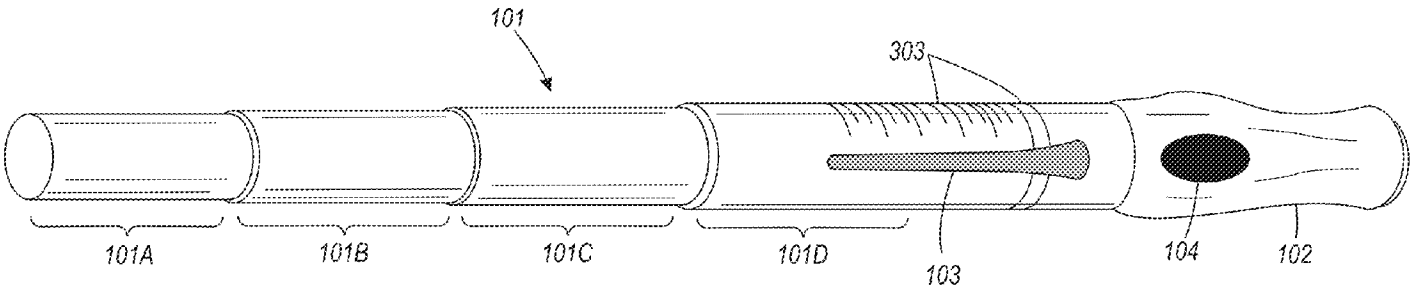
FIG. 1 is a side view of the preferred embodiment of the rolling device.
Figure 2:
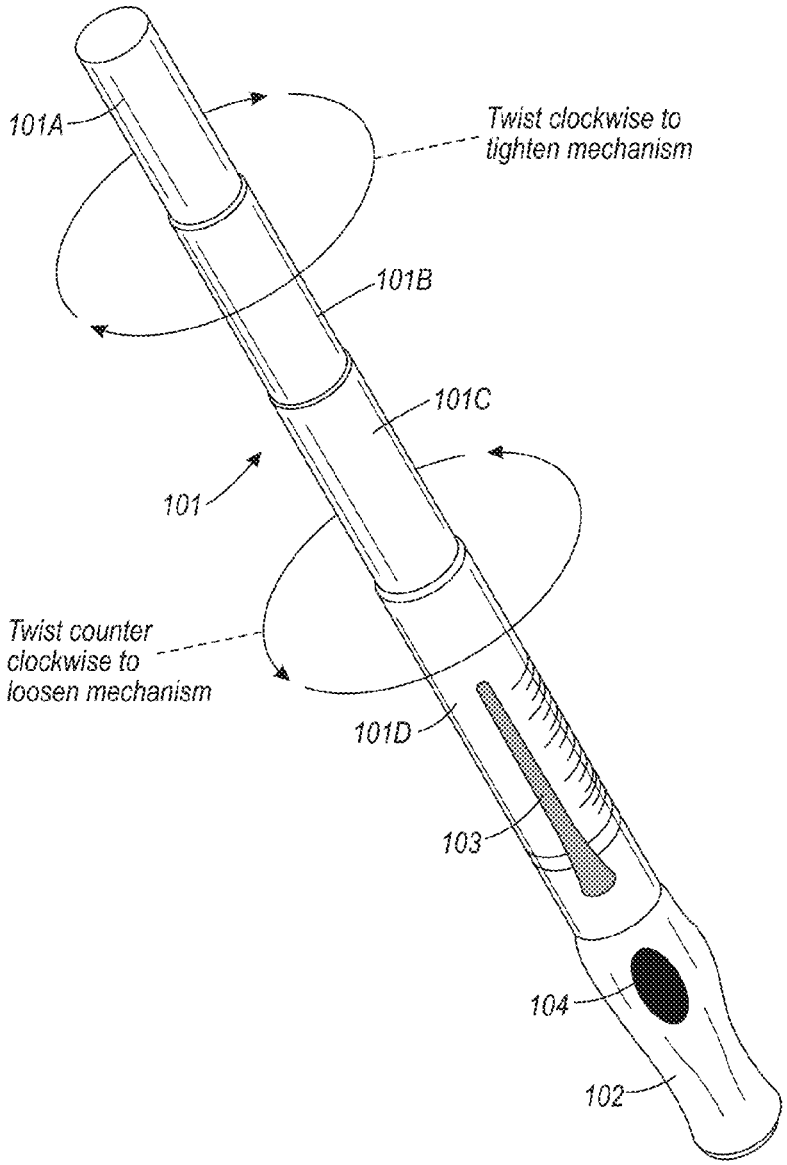
FIG. 2 shows the tension locking mechanism of the adjustable length rod to extend or retract by twisting to tighten or loosen the rod.
Figure 3A:
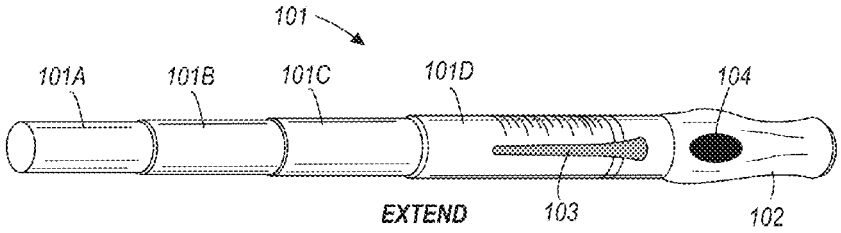
FIG. 3A shows the adjustable length rod in its extended position.
Figure 3B:
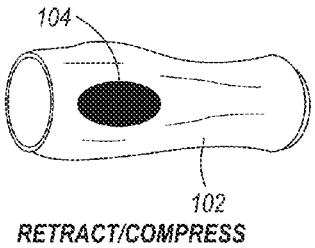
FIG. 3B shows the adjustable length rod in its retracted position.

As shown in FIG. 1, the roller comprises an adjustable length rod 101 that can be set to various desired lengths due to its free sliding and tension locking mechanism. The adjustable rod 101 is made out of super smooth, static free, recyclable plastic. Adjusting the length of the rod 101 is very simple. Referring to FIG. 2, to control the mechanism, the user twists the rod 101 counterclockwise to loosen the rod 101, allowing the rod 101 to slide effortlessly. At this point the rod can be compressed or extended to the desired length. Once the rod 101 has been set to the needed length, which is most often based on the size of the garment or other item to be rolled, the user then twists the rod clockwise to tighten up the rod and lock it in place. FIG. 3A illustrates the rod 101 in its extended state. FIG. 3B shows its compressed or retracted state. Thus, the adjustable length rod can be extended to its desired size.

The adjustable length rod 101 is made up of multiple sub-rods 101A, 101B, 101C, 101D, whereby each is capable of being expanded or contracted. The sub-rod on the last end is capable of being housed in the sub-rod immediately next to it as the adjustable length rod 101 is being retracted or compressed. And the more the rod 101 is contracted, the same pattern of a sub-rod housing its adjacent neighbor sub-rod continues.

Figure 15:
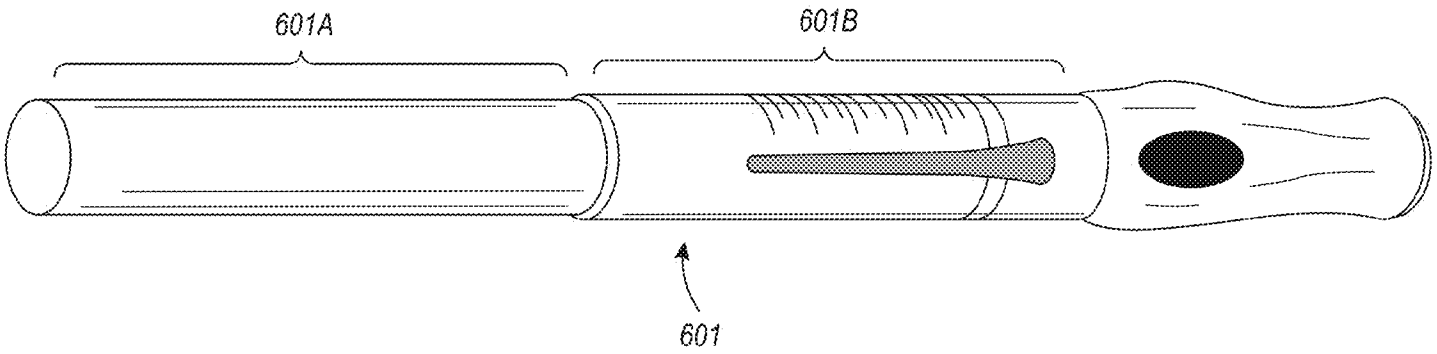
FIG. 15 is a side view of another embodiment of the roller device with only two sub-rods making up the adjustable length rod.

In a preferred embodiment, the roller device will contain four sub-rods that make up the adjustable length rod 101. However, in a different embodiment the rod can also have 2 sub-rods that are capable of expanding and contracting. FIG. 15 illustrates the simplest adjustable length rod 601 with only 2 such pieces 601A and 601B capable of expanding and contracting. It should be noted that the extendable rod is not bound to any specific lengths like it would if the different sub-rods clicked into place like most extendable items. Instead, the tension technology allows one to take advantage of every single millimeter of the device, allowing it to match it up perfectly to any size garment, even super thin items that are hard to grasp.

Figures 4A, 4B:
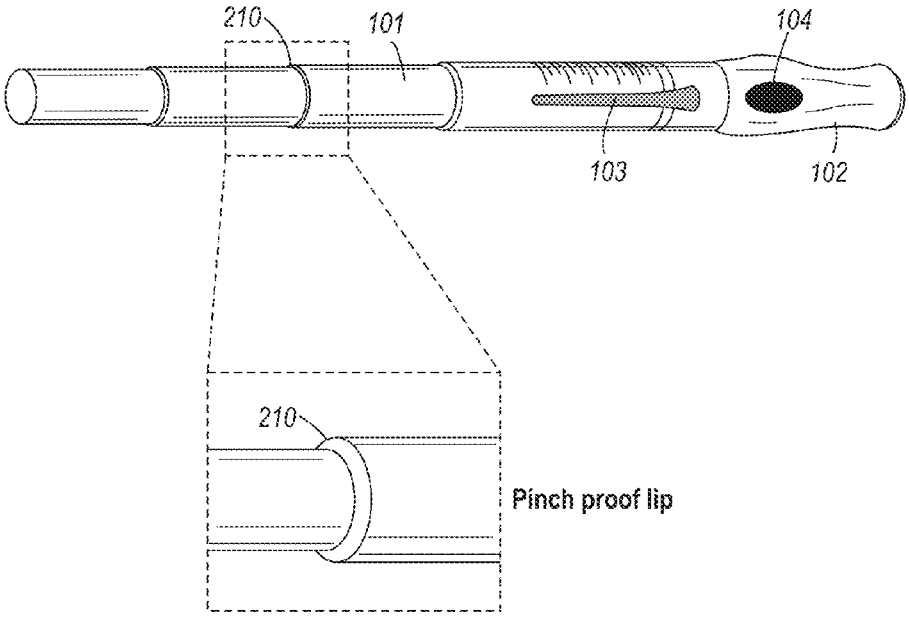
FIGS. 4A and 4B is a close-up view of the pinch proof countered lip for a sub-rod joint of the adjustable length rod.

Further, as shown in FIGS. 4A and 4B, the adjustable length rod 101 is also pinch-proof due to the countered lips for each joint 210 of the adjustable length/extendable rod. Each joint or connection is where the adjacent sub-rods meet. Since these joints have perfectly countered lips 210, the rod will not pinch the user or interfere with the garment item during use of the roller device.

Figure 5A:
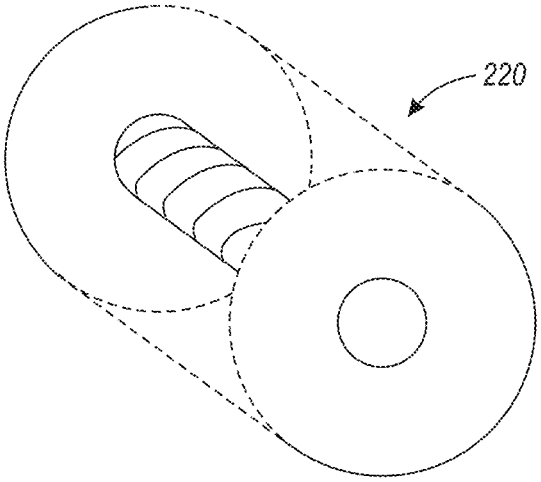
FIGS. 5A and 5B are close-up views of the twisting tension mechanism in the adjustable length rod.
Figure 5B:
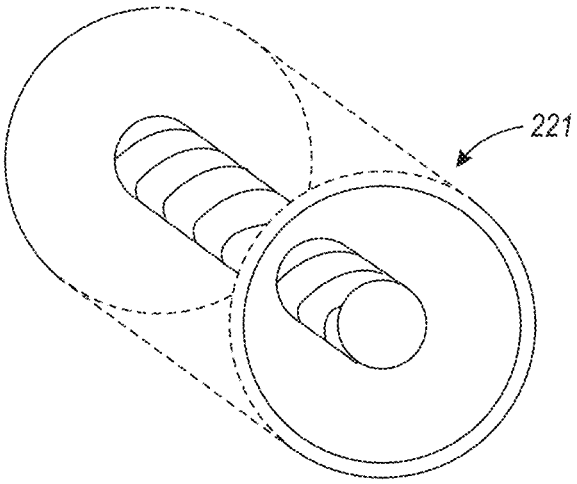

FIGS. 5A and 5B further illustrate the tension mechanism of the adjustable length rod. In FIG. 5A, the tension mechanism 220 is engaged since the rod was twisted clockwise, locking the rod into place. In FIG. 5A, the tension mechanism 221 is unlocked as it is twisted counter clockwise.

Figure 9:
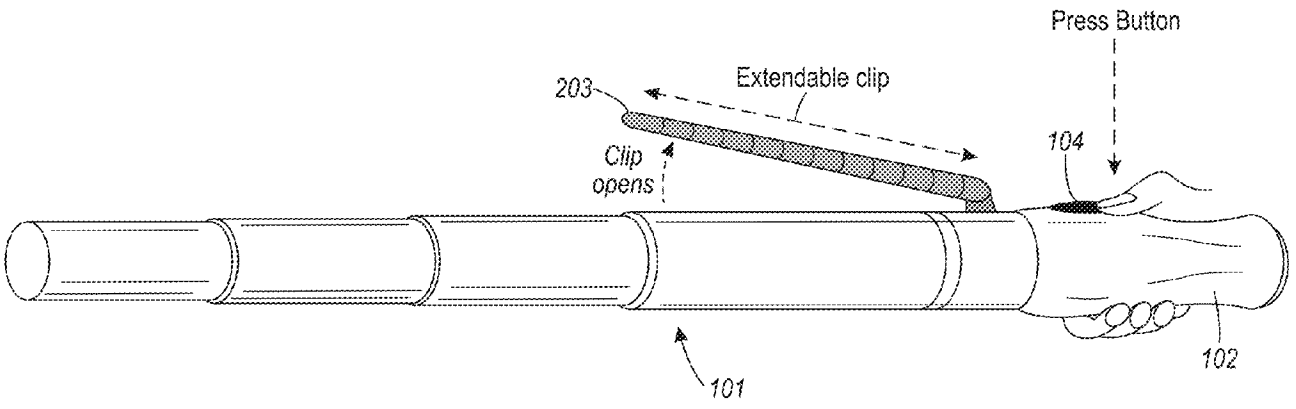
FIG. 9 is a view of the securing clip as it opens after the user presses the button for the securing clip on the handle.
Figure 10A:
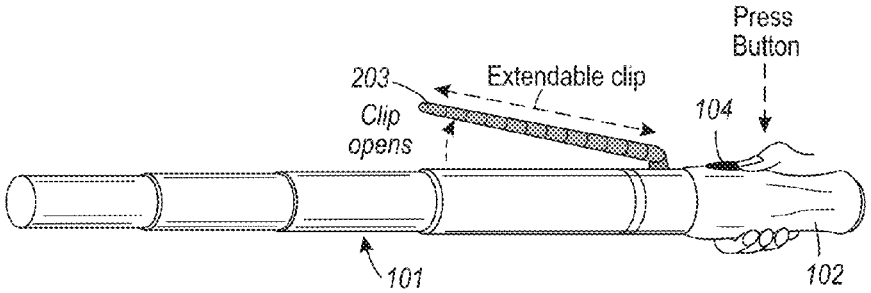
FIGS. 10A, 10B and 10C is a detailed and close-up view of the securing clip mechanism.
Figure 10B:
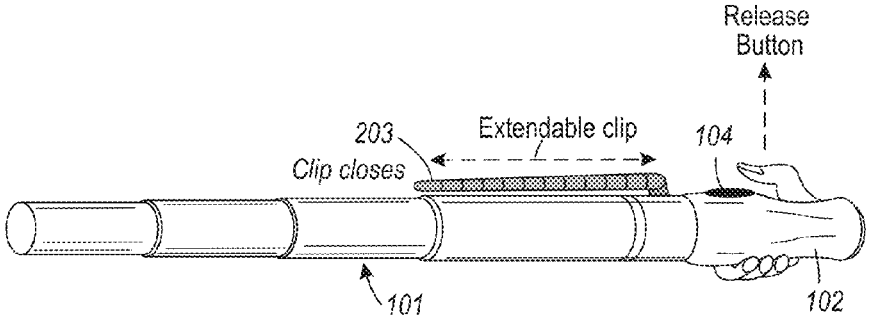
Figure 10C:
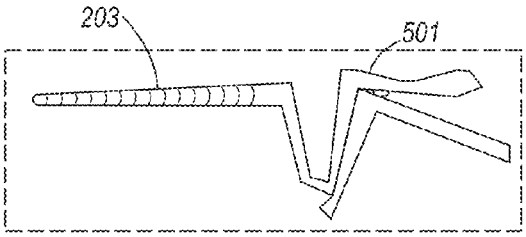

On one end of the roller and the adjustable length rod 101 is the handle 102 that is contoured for a comfortable grip and equipped with a non-slip securing clip 103. FIG. 9 shows the handle 102 as well as the securing clip. In order to operate the securing clip 103, the user presses and releases a button 104 provided on the handle 102. This is similar to clicking the light on and off on certain kinds of flashlights. The button 104 is preferably made of rubber material for comfort and ease of use. The press and release of the button 104 causes the jaws of the securing clip 103 to open or close. This is achieved through an internal mechanism that controls the level of pressure that is placed on the leg portion 501 of the clip (FIG. 10C). FIG. 10A-10C demonstrates the mechanism of the securing clip 103. The securing clip 103 is shaped internally such that it remains flat and sleek with the lines of the portions of the roller on the outside.

When the user presses down the button 104 once and release it, the clip 103 opens up and a clicking noise is heard as the clip locks in its open position. If the button is pressed and released again, it will click once as the clip closes and stays closed until the button is pressed again. This process is fluid, secure, precise and consistent due to the above-described clipping system (See FIGS. 10A-10C).

Figures 11A, 11B:
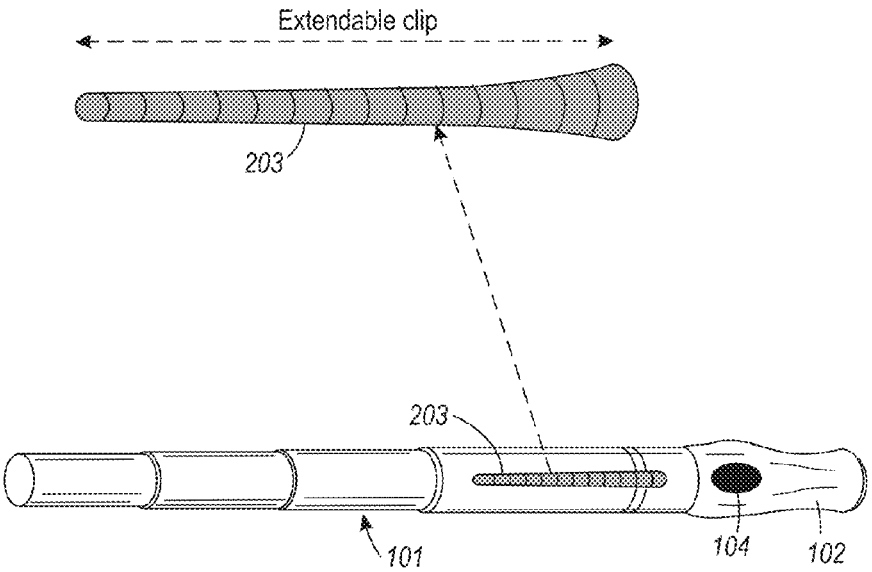
FIGS. 11A and 11B shows the extendable securing clip.

In a preferred embodiment, the securing clip will be an extendable clip that can be manually extended out or compressed down. This is illustrated in FIGS. 11A and 11B. Once the user adjusts to the desired length, the extendable securing clip 203 is used the same way as before.

The roller also contains safety mechanisms in order to prevent or decrease the likelihood of potential hazards during use of the device. As noted above, one safety feature of the roller device is the pinch-proof extendable rod consisting of the countered lips in each of the joints of the sub-rods, which prevents the user from getting pinched.

Figures 12A, 12B:
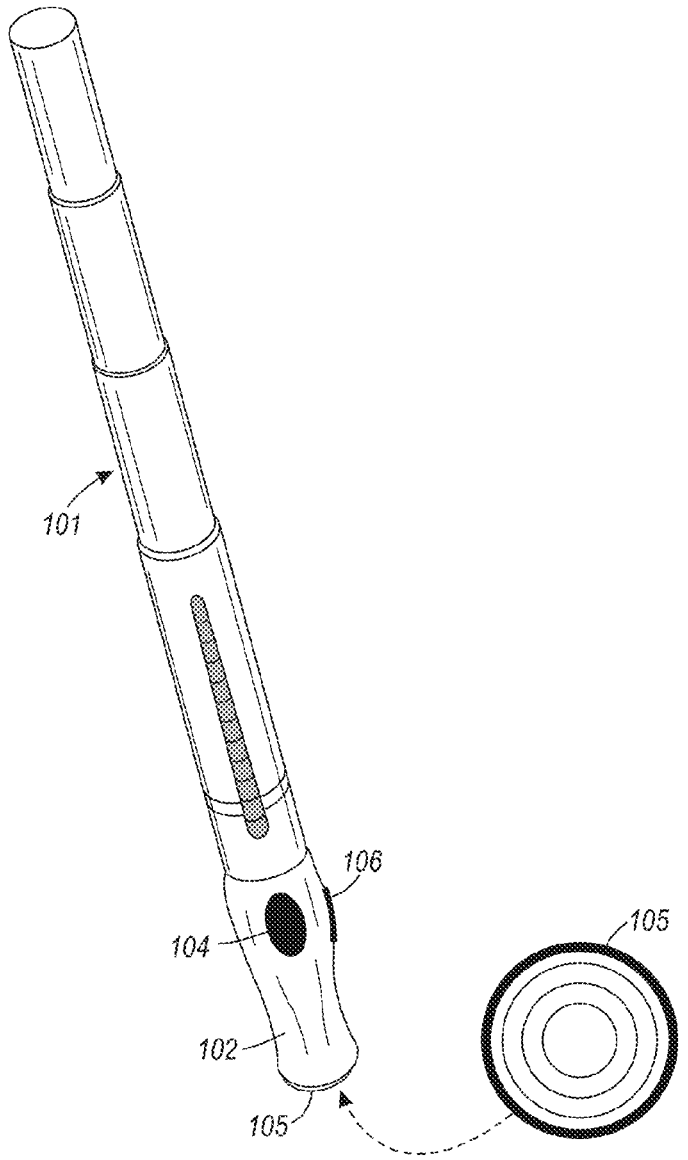
FIGS. 12A and 12B is a view of the quick-release button located on the end of the handle.

Another safety mechanism is a quick-release emergency button 105 placed on the end of the handle 102, as seen in FIGS. 12A and 12B. This quick-release emergency button 105 (FIG. 12B) takes up a majority of the handle's end surface where the button is placed. This is to ensure the operation of the safety feature as intended and to maximize the chances of it working correctly and efficiently. There is a potential danger of the roller and rod 101 being fully extended and locked into place, which could harm someone if he or she landed on it with the rod 101 facing up. This is illustrated in FIGS. 13A and 13B. If the rod 101 is pointing upwards, then the handle 102 is facing the ground or some other surface that the roller is on. If a person using the roller falls on the rod in its fully extended and completely locked state, the entire device would try and take on that weight of the person falling on it. Accordingly, pressure would be placed on the handle's quick-release emergency button 105, and the button 105 would quickly release the rod 101 from being in its locked state. In other words, pressing the button releases the tension on the bungee cord, which disables the rods locking mechanism. As seen in FIG. 13B, this will allow the rod 101 to easily retract into the handle 102 and stay in that state until it is safe to disengage the quick-release button. This safety function can be performed at any length the rod is set to, and is not limited to only working as a safety mechanism in its fully extended setting. As soon as the button 105 is disengaged, the rod will go back to its normal functionality, so the user should make sure to have the rod position correctly.

Figure 14A:
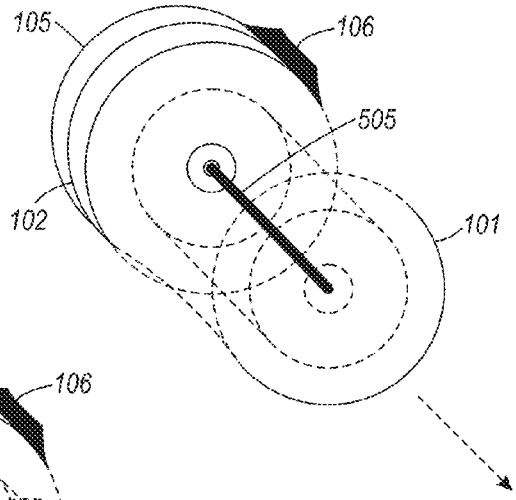
FIGS. 14A, 14B and 14C are a close-up view with a detailed illustration of the quick-release mechanism and how the quick-release button releases tension on the cord and disables the tension mechanism.
Figure 14B:
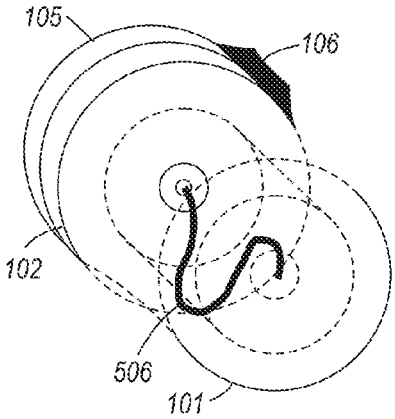
Figure 14C:
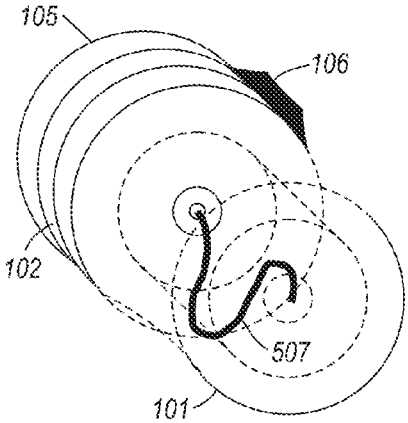

FIGS. 14A-14C further explains the mechanism of the quick-release safety feature. The bungee corded system works by maintaining full tension of the bungee cord 505 when the quick-release emergency button 105 is disengaged. When disengaged, this quick-release button 105 is in its fully upright or popped out state. It is this tension that allows the system to stay locked in place so that the device can be used properly. Referring to FIG. 14B, when the quick-release button 105 is engaged, meaning that the button has been pressed or pushed in or triggered, either because someone pushed the quick-release button for safety purposes or simply to quickly retract the rod 101 after use, or due to the tip of the rod 101 receiving pressure while the handle 102 is butted up against something (i.e., person falling on the rod 101 while the handle 102 and quick-release button touch the ground), the tension on the bungee cord 506 is released and the tension is disabled by slipping it out place. Thus, a significant amount of slack is created in the bungee cord, disabling the rod's tension locking mechanism as it slips out of place with no tension to feed off of (also seen in FIG. 14C). The quick-release emergency button is a click-on, click-off button like the button for the securing clip, but the difference between the two positions is more apparent and noticeable at all times. When the quick-release button 105 is in its disengaged position, it is noticeably distended and the rubber end is pulled fairly taught, though ready to be pressed in if needed at any time. On the other hand, when the quick-release button 105 is engaged, the rubber end has play or space around it and may even contain several wrinkles as the button itself underneath the rubber sounds as if it is rattling around. This allows for quick recognition of the particular position the quick-release button 105 is in so that the user can ensure it is in the safest setting for a desired task.

The bungee cord 505 inside the adjustable length rod 101 connects from the end of the handle 102 to the other end of the inside of the adjustable length rod 101.

Another safety mechanism feature is the quick-release slide switch 106. The quick-release slide switch 106 is located on the handle 102, similar to the button for the securing clip. This is another form of the quick-release function. It functions the same way by creating slack in the tension of the bungee cord so that the tension locking mechanism does not work. The process of using the quick-release slide switch 106 is simple. Sliding the switch up will shorten the distance between the mechanism and the point that the bungee connects, causing a bungee cord that was pulled taut to now have slack 507. Thus, the tension will not work. Sliding the switch back down slips the mechanism back into its proper place as the full functionality is restored. FIGS. 14A-14C show the quick-release slide switch in its operation In a preferred embodiment, the roller device will have a quick-release safety mechanism consisting of both the quick-release emergency button on the end of the handle 102, as well as the quick-release slide switch located on the handle 102. However, in other embodiments, the device can have just one of either the quick-release emergency button or the quick-release slide switch.

Figure 6:
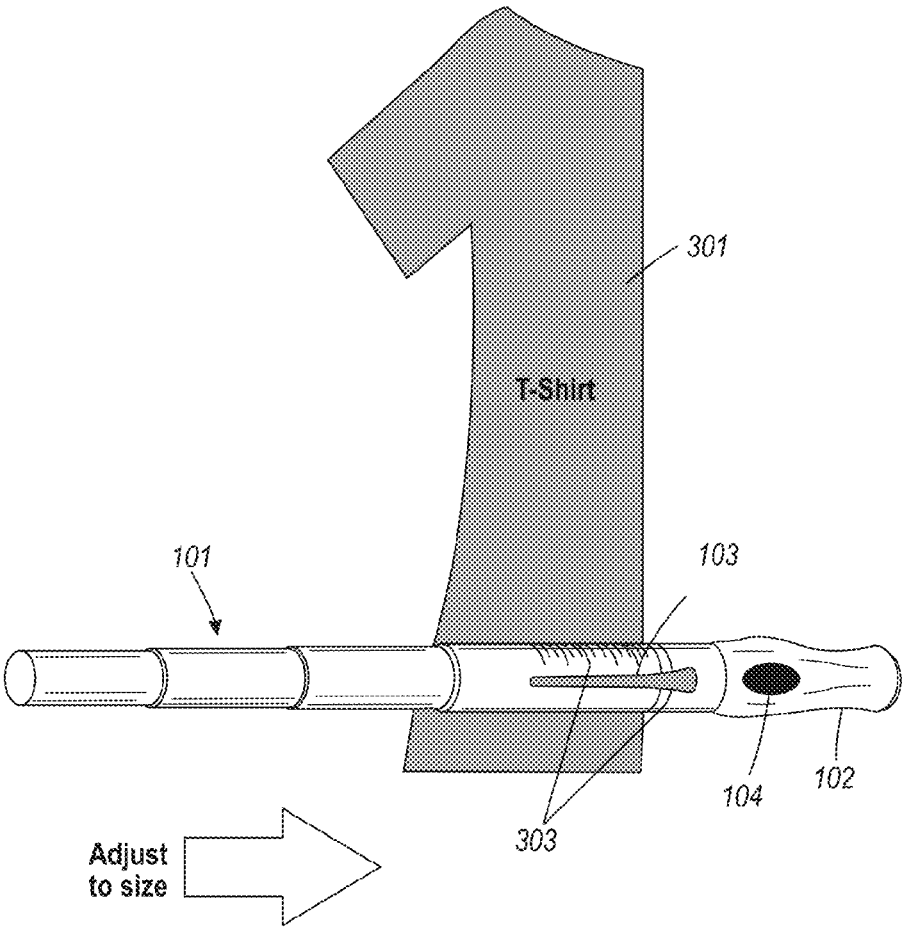
FIG. 6 is a view of the rolling device about to roll a garment item that is a t-shirt.

Now that all of the components of the roller have been described in detail, the following section describes how one uses the device to roll garments and other items such as towels, sheets, tarps, clothing items or fabric, wires, cables, cords, food items, and other items that can be rolled up. Referring to FIG. 6, the garment 301, or other item to be rolled, is first laid down on a table or surface to roll it on. The user then takes the roller, holding the handle 102 in his or her dominant hand and placing the other hand on the extendable rod 101 tip, and twists the extendable rod counterclockwise to loosen the mechanism. This allows the user to adjust the length of the roller's extendable rod 101 and pull the rod 101 out of the handle 102. Then, the user lays the device across the very bottom of the garment 301 about to be rolled, as seen in FIG. 6. Here, it is important that the edge of the garment 301 is lined up with the provided guideline marked on the extendable rod 303. This is located near the handle and clearly labeled. Further, markings at certain intervals (like a ruler) extend from that point for added convenience, providing the user with measuring capabilities. Next, the user adjusts the length of the extendable rod 101 to the desired length.

Figure 7:
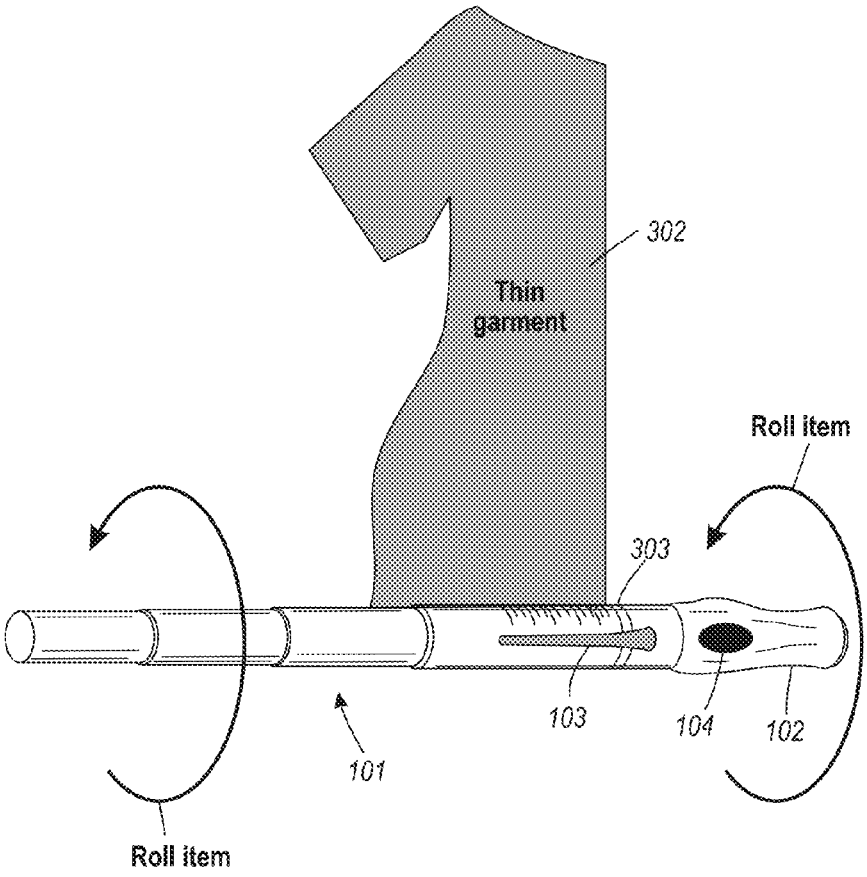
FIG. 7 is a view of the rolling device about to roll a thin garment item that is a t-shirt.

Once at the right size, the rod 101 is twisted clockwise to lock it in place. As noted before, the extendable rod is not bound to any specific lengths like it would if the different lengths clicked into place like most common extendable items. As shown in FIG. 7, the tension technology in the rod allows one to take advantage of every millimeter of the device, allowing it to match perfectly to any sized garment or other item, including very thin items otherwise hard to grasp 302. Once the item is lined up with the extendable rod 101, the item needs to be secured to the device. The user pulls the device the handle 102, sliding the device out slightly, then presses the button on the handle 102 to activate the securing clip 103. There will be a clicking sound as the jaws of the securing clip 103 remain open. As stated earlier, an extendable clip head may be used to have a more accurate securing clip 103 for a given item that is to be rolled. Once the securing clip 103 is slipped under the edge of the garment or similar item, the button for the clip is pressed again, and the jaws will close to secure the garment to the device. With one hand on the handle and one hand on the end of the rod 101 where the garment is not clipped in, the user starts rolling.

Figure 8A:
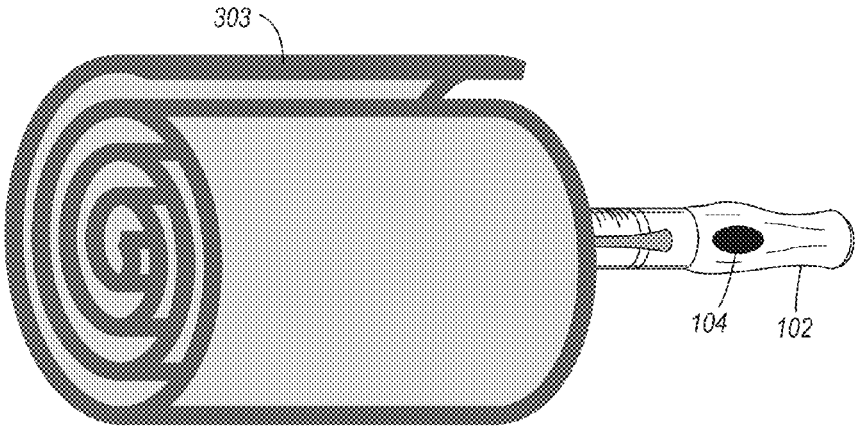
FIGS. 8A and 8B show the removal of the rolling device after the garment item has been rolled.
Figure 8B:
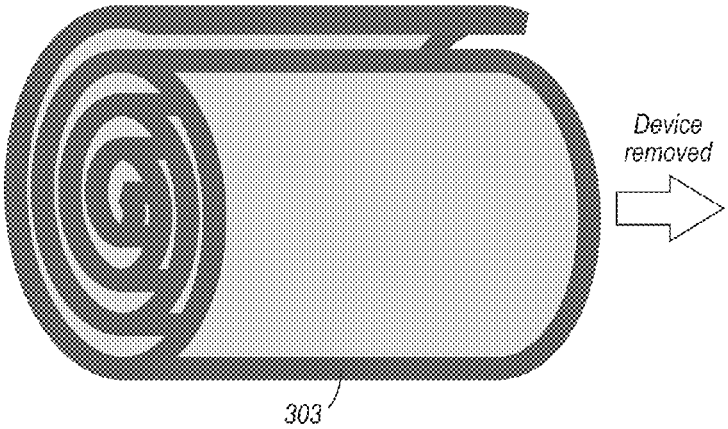

Once the roll is completed and the garment item has been rolled 303, the button for the clip is pressed again for the clip to open, and the user gently pulls the handle 102 end to easily remove the device, as illustrated in FIG. 8A-8B. It shall be pointed out that the quick release button and switch are available in the event of a hazardous situation. However, the safety mechanisms also serve a dual purpose as they can be used for efficiency in adjusting the sizes of the rod 101.

Once finished using the device, the rod 101 is twisted counterclockwise to loosen the adjustable length mechanism so that the rod can be compressed down to its smallest size. Then, the tip of the rod can be twisted to tighten it and lock it in place. Alternatively, the quick release button and slide switch can also be used to collapse the rod. FIGS. 14A-14C illustrates the safety mechanism. Once the rod 101 collapses into the handle, it can be locked in by twisting the rod by the tip clockwise. Alternatively, if the rod was released using either of the two safety features, the rod can be locked into the handle 102 by hitting the quick release button on the bottom of the handle or the quick release slide switch on the side again. FIG. 3B displays the rod retracted all the way into the handle 102. This allows the device to be small and compact enough to store away in a drawer or to tuck it in a suitcase when traveling.

In another embodiment, the rolling device will be made of higher tier material, such as finely sanded and incredibly smooth wood, or sleek, smooth, sturdy titanium in a brushed or glossy finish. Another embodiment consists of electrical components in the handle that will be used for plugging in and powering chargeable rods capable of producing different functions. Such functions may consist of an ionization function, a fabric steaming function, a blow drying function and an ironing function. Furthermore, the rods can also extend and contract electronically. A button can control the electrical capability. The blow dryer head and iron head will be fixed plug-in components and not extendable. To use this device, the solid titanium rod or wooden rod is plugged in and twisted clockwise to lock it in place. Then the device is used exactly the same as described above in the specification. For the ionization feature, the ionization head is inserted and locked in by twisting clockwise. Then the device is switched to ion mode to alleviate the static electricity often held in certain fabrics. To use the fabric steaming functionality, the fabric steamer rod can be inserted and twisted clockwise to lock it in place. Once water is poured in the nose/tip of this rod and the device is flipped to steam mode, the steam will be activated. Now, items can be rolled while allowing a very low grade of steam to emit, which allows clothes to stay wrinkle free. The user can also choose to emit a larger amount of steam. To use the blow dryer function, the current rod is again removed and the blow dryer is head is inserted in place. Lastly, an iron head can be inserted for ironing clothing.

A charging dock will be provided into which the handle will be plugged to charge any inserted piece. Though the attachments are electrical, they do not produce their own power and simply get the needed power via the handle they are plugged into.

While the present invention has been described herein with reference to particular embodiments thereof, a latitude of modifications, various changes and substitutions are intended in the foregoing disclosure, and it will be appreciated that in some instances some features of the invention will be employed without a corresponding use of other features without departing from the spirit and scope of the invention as set forth in the appended claims.

The invention claimed is:

1. A device for rolling a garment item, comprising:

an adjustable length rod, made up of at least two sub-rod pieces, operable to move between a locked position and a retractable position by twisting the adjustable length rod;

a handle on one end of the adjustable length rod capable of fully housing the adjustable length rod when fully retracted in the retractable position;

a securing clip operable to move between an open position and a closed position connected to the handle used to secure the garment item to the adjustable length rod;

a securing clip button on the handle for triggering the securing clip to the open or closed position;

a quick-release safety mechanism having a quick-release button on the end of the handle that is movable between an engaged position in which pressure is applied to the quick-release button to release the adjustable length rod into the retractable position, and a disengaged position in which no pressure is applied to the quick-release button causing the adjustable length rod to be in the locked position;

the quick-release safety mechanism also having a quick-release slide switch that is movable between an up position in which the adjustable length rod is released into the retractable position, and a down position in which the adjustable length rod remains in the locked position.

2. The device in claim 1 wherein the adjustable length rod is made up of four sub-rod pieces.

3. The device in claim 1 wherein the securing clip is an extendable securing clip.

4. The device in claim 1 wherein the quick-release button covers a majority of the surface area of the end of the handle.

5. The device in claim 1 wherein the adjustable length rod comprises guideline markings for lining up the garment item with the adjustable length rod.

6. The device in claim 1 wherein the adjustable length rod is made out of smooth, static free, recyclable plastic.

* * * * *